US007369796B2

(12) United States Patent
Amano et al.

(10) Patent No.: US 7,369,796 B2
(45) **Date of Patent: *May 6, 2008**

(54) DEVELOPER APPARATUS, IMAGE FORMING APPARATUS AND TONER SUPPLYING METHOD

(75) Inventors: Takafumi Amano, Kawasaki (JP); Takashi Ikeda, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 372 days.

This patent is subject to a terminal disclaimer.

(21) Appl. No.: 11/180,655

(22) Filed: Jul. 14, 2005

(65) Prior Publication Data

US 2007/0014591 A1 Jan. 18, 2007

(51) Int. Cl.
*G03G 15/08* (2006.01)
*G03G 21/00* (2006.01)

(52) U.S. Cl. ..... 399/254; 399/255; 399/359

(58) Field of Classification Search ..... 399/254–256, 399/258, 259, 359
See application file for complete search history.

(56) References Cited

U.S. PATENT DOCUMENTS 7,006,784 B2 * 2/2006 Ikeda et al. ..... 399/359
7,024,151 B2 * 4/2006 Katoh et al. ..... 399/359
7,031,644 B2 * 4/2006 Ikeda et al. ..... 399/254
2005/0111883 A1 5/2005 Amano et al.

FOREIGN PATENT DOCUMENTS

JP 5-249824 A 9/1993

OTHER PUBLICATIONS

U.S. Appl. No. 10/802,046, filed Mar. 17, 2004, Ikeda et al.
U.S. Appl. No. 10/802,047, filed Mar. 17, 2004, Ikeda et al.

* cited by examiner

*Primary Examiner*—David M. Gray
*Assistant Examiner*—Erika J. Villaluna
(74) *Attorney, Agent, or Firm*—Foley & Lardner LLP

(57) ABSTRACT

An image forming apparatus includes a first mixer 24*a* that conveys developer in the first direction while stirring the developer. Recycled toner delivered from a delivery opening 116*b* of a photosensitive drum cleaner 116 is supplied to an upstream side of the first chamber that contains the toner that is to be supplied to a developing position on a photosensitive drum 103 to which a predetermined potential is applied by a developing roller 27 formed rotatable.

24 Claims, 5 Drawing Sheets

DEVELOPER APPARATUS, IMAGE FORMING APPARATUS AND TONER SUPPLYING METHOD

BACKGROUND OF THE INVENTION

1. Field of the Invention

The present invention relates to an image forming apparatus that forms an image with use of a developer.

2. Description of the Related Art

Image forming apparatus that use a developer including toner form an image, for example, in the following manner. That is, first, an electrostatic latent image is formed on a photosensitive drum serving as an image carrier, and the latent image is developed by a developer unit. Then, the toner image thus obtained is transferred onto a sheet by a transfer portion, and the image is fixed onto the sheet by the fuser.

Of the image forming apparatus, a type which removes toner remaining on the photosensitive drum after transfer of a toner image onto a sheet by a cleaning unit, and recycles collected toner, which is to be called recycle toner hereinafter, is conventionally known.

In connection with the above, for example, a toner recycle mechanism is conventionally known. With this mechanism, recycle toner is returned directly into a developer unit as the recycle toner carried by the collecting mixer provided in the cleaning unit is conveyed by the coupling mixer provided between the cleaning unit and the developer unit.

With the above-described structure, the collected recycle toner is being supplied to the developer unit whenever the collecting mixer and coupling mixer are rotated.

The recycle toner to be re-used contains toner particles from which a unique external additive is partially peeled off, or toner particles to which an external additive peeled off from other particles are attached, or paper dust mixed thereinto. Therefore, as compared to fresh toner whose amount of the external additive is appropriately set, the recycle toner exhibits a slow rising in amount of charge. Further, in case where charging by friction (triboelectrification) caused by stirring is not sufficient, it is possible that the recycle toner is supplied to the photosensitive drummer without being charged at all.

Uncharged toner, due to lack of charge amount, may attach to other parts of the photosensitive drum than the latent image formed thereon, or it may scatter off from the photosensitive drum or paper sheet.

BRIEF SUMMARY OF THE INVENTION

According to an aspect of the present invention, there is provided a developer apparatus comprising:

a first chamber including a first mixer that conveys a developer in a first direction while stirring the developer;

a second chamber including a second mixer that conveys the developer supplied from the first chamber in a second direction different from the first direction while stirring the developer;

a third chamber including a third mixer that conveys the developer supplied from the first chamber in the second direction while stirring the developer;

a fresh developer supply portion located on an upstream side of the second chamber, that receives fresh developer; and a recycled developer supply portion located on an downstream side of the first chamber, that receives recycled developer.

According to another aspect of the present invention, there is provided an image forming apparatus comprising:

an imager carrier that carries an developer image made of a developer by means of electrostatic; and a developer apparatus including: a first chamber including a first mixer that conveys a developer in a first direction while stirring the developer to supply the toner to the image carrier; a second chamber including a second mixer that conveys the developer supplied from the first chamber in a second direction different from the first direction while stirring the developer; a third chamber including a third mixer that conveys the developer supplied from the first chamber in the second direction while stirring the developer; a fresh developer supply portion located on an upstream side of the second chamber, that receives fresh developer; and a recycled developer supply portion located on an downstream side of the first chamber, that receives recycled developer.

According to still another aspect of the present invention, there is provided an image forming apparatus comprising:

an imager carrying means for carrying an developer image made of a developer by means of electrostatic; and a developing means including: a first developer containing means including a first stirring means, for conveying a developer in a first direction while stirring the developer to supply the developer to the image carrying means; a second developer containing means including a second stirring means, for conveying the developer supplied from the first developer containing means in a second direction different from the first direction while stirring the developer; a third developer containing means including a third stirring means for conveying the developer supplied from the first developer containing means in the second direction while stirring the developer; a fresh developer supply portion located on an upstream side of the second developer containing means, that receives fresh developer; and a recycled developer supply portion located on an downstream side of the first developer containing means, that receives recycled developer.

According to still another aspect of the present invention, there is provided a developer supplying method comprising:

collecting a recycled developer from a surface of an image carrier;

delivering the recycled developer from a delivery opening of a clear to a recycled toner supply portion located on a downstream side of a first chamber;

supplying fresh toner to a fresh toner supply portion located on an upstream side of a second chamber at a predetermined timing;

conveying the developer supplied from the first chamber while stirring the developer by using a second mixer provided in the second chamber to supply the developer to the upstream side of the first chamber;

conveying the developer supplied from the first chamber while stirring the developer by using a third mixer provided in the third chamber to supply the developer to the upstream side of the first chamber; and conveying the developer supplied from the second chamber and third chamber while stirring the developer by using a first mixer provided in the first chamber to supply the developer to the surface of the image carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An example of an image forming apparatus to which an embodiment of the present invention is applied will now be described with reference to accompanying drawings.

Figure 1:
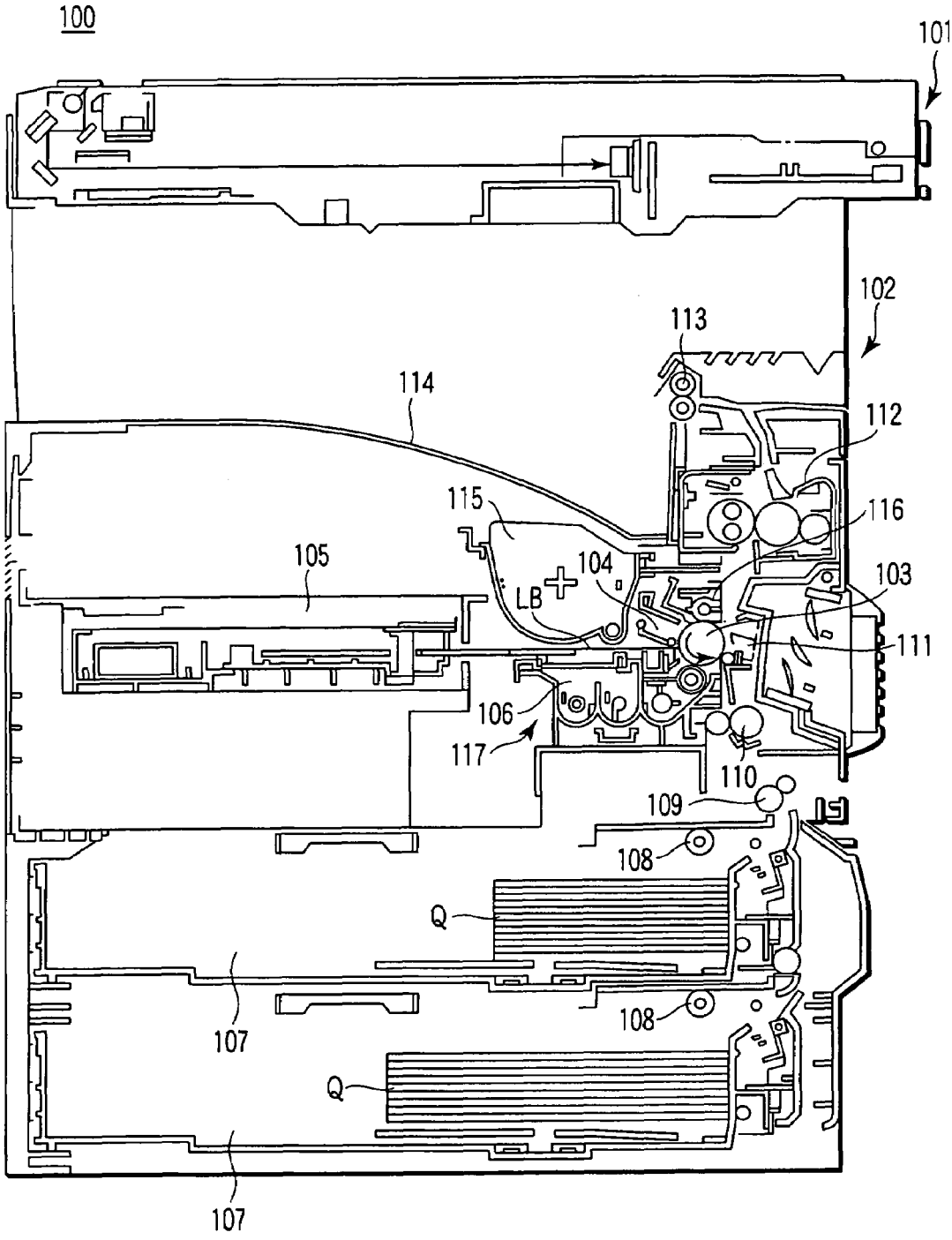
FIG. 1 is a schematic diagram showing an image forming apparatus to which an embodiment of the present invention can be applied.

FIG. 1 schematically shows a front view of an image forming apparatus without its cover.

As shown in FIG. 1, an image forming apparatus (digital copying machine) 100 includes an image reading unit (scanner) 101 designed to read an image on an object (an original) to be read or copied and generate an image signal, and an image forming unit 102 designed to form an image based on the image signal output by the scanner 101 or an image signal provided from outside.

The image forming unit 102 includes a photosensitive drum 103, an electrostatic charging unit 104, an exposing unit 105, a developer unit 106, a paper-feeding cassette 107, a pickup roller 108, a conveying roller 109, an aligning roller 110, a transfer unit 111, a fuser 112, a paper feed-out roller 113, a paper output tray 114, a fresh toner supply unit 115 and a photosensitive drum cleaner 116.

The photosensitive drum (image carrier or image carrying means) 103 includes a photosensitive material on its external circumferential surface. When light is irradiated onto a region of the circumferential surface coated with the photosensitive material while a predetermined potential is applied thereto, the potential of the region irradiated with the light is varied. The variation of the potential can be maintained as an electrostatic image for a predetermined time on the surface. It should be noted that the photosensitive member may be of a belt type other than the drum type.

The electrostatic charging unit 104 is designed to charge the surface of the photosensitive drum 103 to have a predetermined potential. It should be noted that the electrostatic charging unit 104 may be of a corona wire, contact roller or contact blade.

The exposing unit 105 is located on the downstream side of the charging unit 104 in the rotation direction of the photosensitive drum 103. The exposing unit 105 applies a laser beam LB onto the photosensitive drum 103, and the laser beam LB changes its light intensity in accordance with the image signal supplied from the scanner 101. Note that the laser beam LB is capable of having a predetermined light intensity in accordance with the density of the image, etc. Further, the exposing unit 105 may be an LED in place of the laser.

The developer unit 106 is located on the downstream side of the exposure unit 105 in the rotation direction of the photosensitive drum 103 and stores a two-component developer including a carrier and a toner. The developer unit 106 supplies the developer (for example, toner) onto the surface of the photosensitive drum 103. Thus, the latent image on the surface of the photosensitive drum 103 is visualized, and thus a toner image is formed. Note that the developer may be of a one-component developer including toner only.

The paper-feeding cassette 107 houses paper sheets Q, which are picked up one by one by the pickup roller 108. Each sheet Q is conveyed by the conveying roller 109 to the aligning roller 110.

The aligning roller 110 is designed to rotate at a predetermined timing so as to align the sheet Q with the position of the toner image formed on the photosensitive drum 103, and then convey the aligned sheet Q to the transfer position.

The transfer unit 111 applies a predetermined potential to the sheet Q to transfer the toner image on the photosensitive drum 103 onto the sheet Q.

The fuser 112 applies predetermined heat and pressure to the sheet Q on which the toner imager is held, and thus fixes the fused toner image onto the sheet Q.

The paper feed-out roller 113 conveys the sheet Q fed out from the fuser 112 to the paper output tray 114.

The fresh toner supply unit 115 supplies fresh toner (virgin toner), which has not been used for image formation, to the developer unit 106 at a predetermined timing.

The photosensitive drum cleaner (collecting mechanism or collecting means) 116 is located on the downstream side of the transfer position where the photosensitive drum 103 and the transfer unit 111 faces to each other, in the rotation direction of the photosensitive drum 103, and it serves to collect the toner and the like, attached to the surface of the photosensitive drum 103. The photosensitive drum cleaner 116 includes, for example, a cleaning blade or rotating brush that is brought into contact with the photosensitive drum 103.

The photosensitive drum 103, the electrostatic charging unit 104, the developer unit 106 and the photosensitive drum cleaner 116 form a process unit 117. The process unit is formed to be detachable to the main body of the image forming apparatus.

Figure 2:
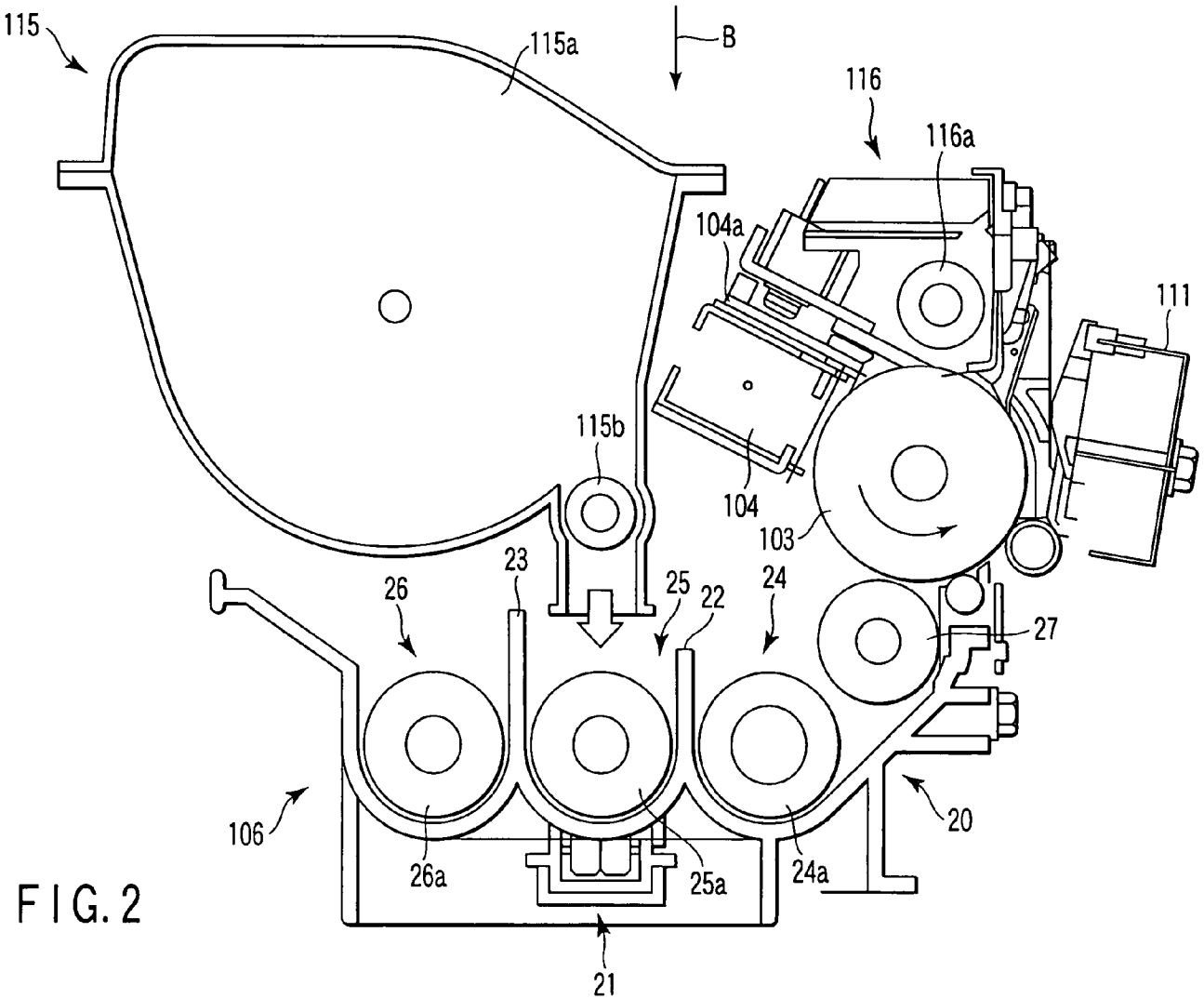
FIG. 2 is a schematic diagram showing a developer unit mounted in the image forming apparatus shown in FIG. 1 and its periphery.
Figure 3:
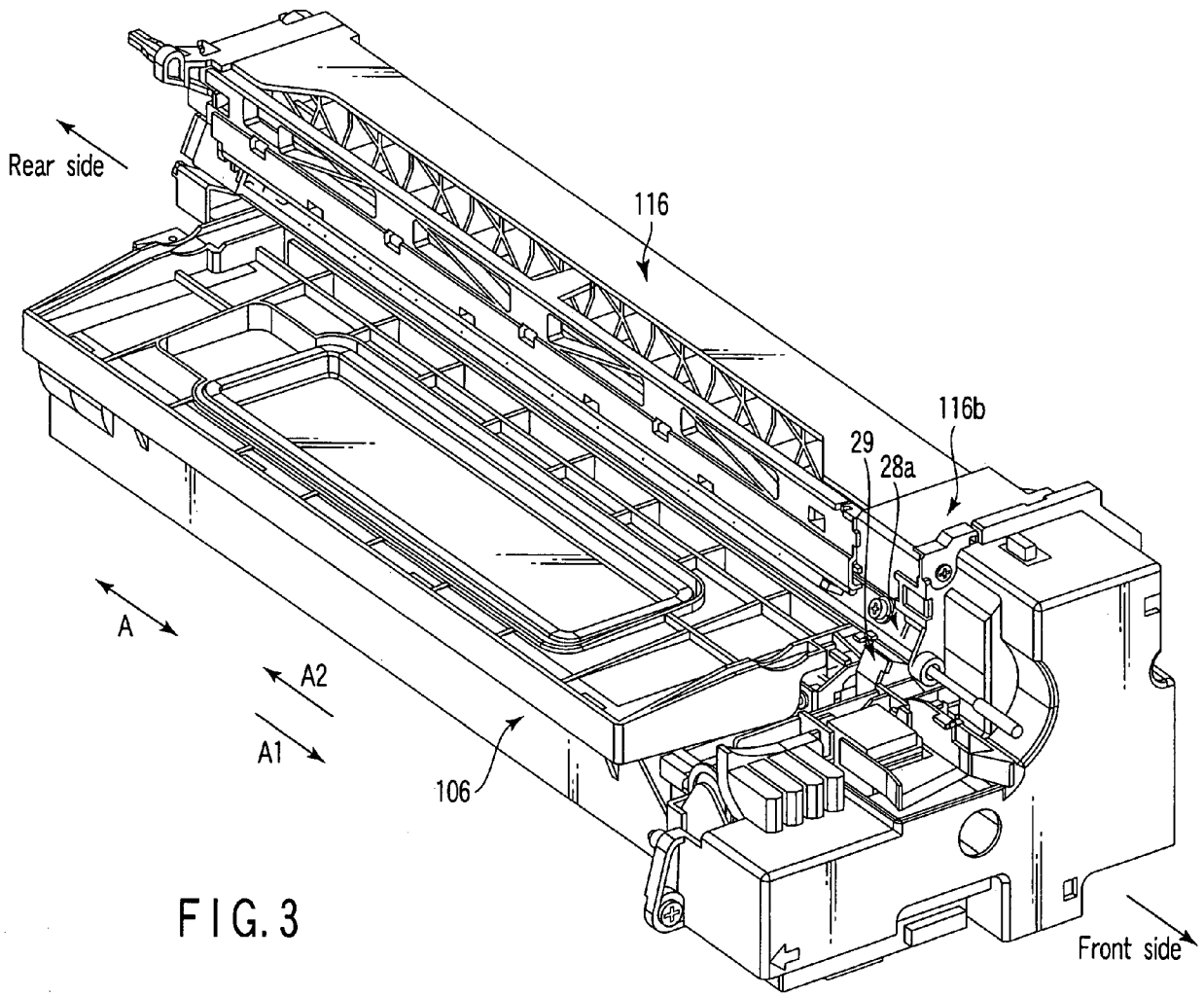
FIG. 3 is a diagram showing the developer unit shown in FIG. 2.
Figure 4:
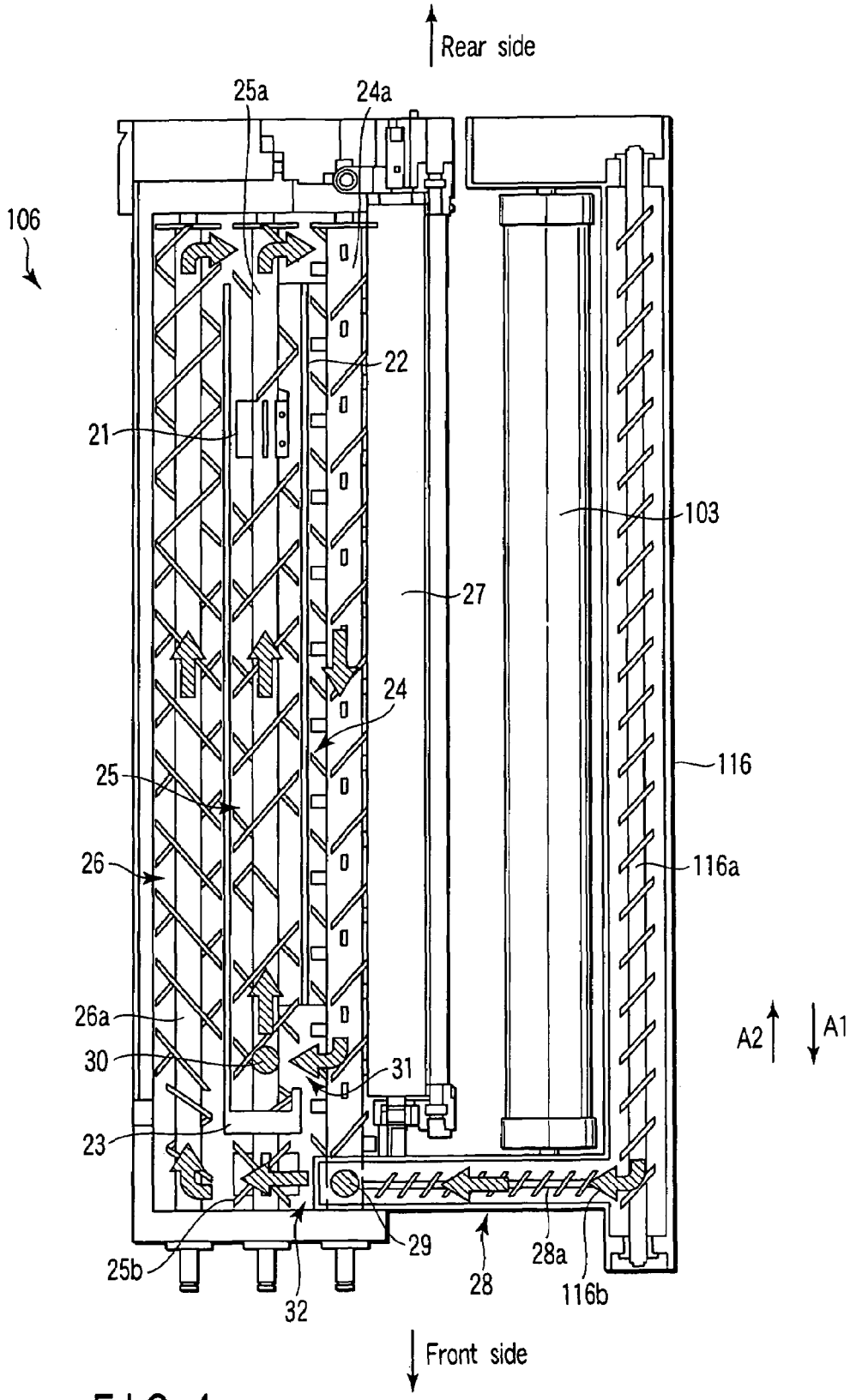
FIG. 4 is a schematic diagram illustrating the operation of the developer unit shown in FIG. 2.

FIG. 2 is a cross sectional view schematically showing a predetermined position in a front side of the developer unit in its longitudinal direction, and a vicinity of the end portion of the mixer. FIG. 3 is a perspective view of the process unit including the developer unit 106 in a covered state. FIG. 4 is a schematic diagram of the developer unit shown in FIG. 2 when viewed from the direction indicated by arrow B in FIG. 2.

As shown in FIG. 2, the developer unit 106 is located underneath the fresh toner supply unit 115, and is provided to face the photosensitive drum 103 at a predetermined position. On the upstream side of the development position in the rotation direction, where the photosensitive drum 103 and the developer unit 106 face to each other, a de-electrification lamp 104*a* and the electrostatic charging unit 104 are arranged. On the downstream side, the transfer unit 111 and the photosensitive drum cleaner 116 are arranged in this order.

The fresh toner supply device 115 includes a fresh toner cartridge 115*a* containing fresh toner and a supply roller 115*b* that rotates at a predetermined timing and supplies the fresh toner to a predetermined position of a second chamber 25. The fresh toner cartridge 115*a* is formed to be detachable to the main body of the image forming apparatus.

The photosensitive drum cleaner 116 includes a collected toner conveying roller 116*a* located above the developer unit 106, which conveys collected recycle toner (used toner) to the front side, and a toner delivery opening (delivery means) 116*b* used to deliver the recycled toner to the developer unit 106.

The developer unit 106 includes a developer container 20 that contains a two-component developer (to be called simply a developer) that consists of a carrier and toner, and a magnetic sensor 21 housed in the developer container 20 so as to detect the concentration of the toner. It is preferable that the magnetic sensor 21 is located at a predetermined position in a lower portion of the developer container 20.

The developer container 20 includes a first chamber (first developer containing means) 24, a second chamber (second developer containing means) 25 and a third chamber (third developer containing means) 26.

As shown in FIG. 4, the first chamber 24 is equipped with a first mixer (first stirring means) 24*a* having an axis parallel to an axial direction A of the photosensitive drum 103, and it conveys the developer in the first direction to stir the carrier and toner, and applies a predetermined potential to the toner. The toner is supplied to the development position of the photosensitive drum 103 by a developer roller (developer carrier member) 27 provided to be rotatable.

The first mixer 24*a*, as it is rotated, conveys the developer in the first chamber 24 from a rear side to the front side, that is, in the first direction A1 at a first speed while stirring the developer. In other words, the first mixer 24*a* supplies the developer received from the second mixer 25*a* and the third mixer 26*a*, which will be described later, to the developer roller 27 while stirring and conveying the developer. Further, the first mixer 24*a* receives the developer peeled off from the developer roller 27 after a development, and conveys.

The second chamber 25 is equipped with the second mixer (second stirring means) 25*a* having an axis parallel to the axial direction A, and it conveys the developer in the second direction, which is different from the first direction, to stir the carrier and toner, and applies a predetermined potential to the toner. The second chamber 25 is separated from the first chamber 24 by a first partition 22. The first partition 22 has such a predetermined length that the first chamber 24 and second chamber 25 are connected by the rear side and front side. It should be noted that a first communicating portion 31 that is connected to the downstream side of the first chamber 24 is located on the upstream side of the second chamber 25.

The second mixer 25*a*, as it is rotated, conveys the developer in the second chamber 25 from the front side to the rear side, that is, in the second direction A2 at the first speed as in the case of the first mixer 24*a* while stirring the developer. In other words, the second mixer 25*a* conveys the developer received from the first mixer 24*a* while stirring it, and then conveys the fresh toner received from the fresh toner supply unit 115 to first mixer 24*a* while stirring it with the developer and supplies the mixture to the first mixer 24*a*. The second mixer 25*a* is provided at its front end portion with a conveying blade 25*b* used to convey the recycled toner supplied to the recycled toner supply portion (used developer supply portion) 29 to the third chamber 26.

The third chamber 26 is equipped with the third mixer (third stirring means) 26*a* having an axis parallel to the axial direction A, and it conveys the developer in the second direction A2 to stir the carrier and toner, and applies a predetermined potential to the toner. The third chamber 26 is separated from the second chamber 25 by a second partition 23. The second partition 23 has such a predetermined length that the second chamber 25 and third chamber 26 are connected by the rear side.

It should be noted that a second communicating portion 32 that is connected to the downstream side of the first chamber 24 is located on the upstream side of the third chamber 26, and thus the second communicating portion 32 is separated from the first communicating portion 31 by the second partition 23. In this embodiment, the second partition 23 has an L-letter shape and functions as a shut-off plate that inhibits the developer containing the fresh toner in the second chamber 25 from entering thereinto, as well as a guiding plate that guides the developer conveyed from the first chamber 24 to the second chamber 26.

The third mixer 26*a*, as it is rotated, conveys the developer in the third chamber 26 from the front side to the rear side, that is, in the second direction A2 at a second speed, which is slower than the first speed, while stirring the developer. The third speed may be at such a rate that can sufficiently arise the frictional charge on the recycle toner. In other words, the third mixer 26*a* conveys the recycle toner received from the recycle toner supply mechanism 28 while stirring it together with the developer, and then supplies the mixture to the second mixer 25*a*.

The recycle toner supply portion (used developer supply portion) 29 is located on the downstream side of the first chamber 24, and the recycle toner collected from the surface of the photosensitive drum 103 is supplied thereto from the toner delivery opening 116*b* of the photosensitive drum cleaner 116.

The fresh toner supply portion (unused developer supply portion) 30 is located on the upstream side of the second chamber 24 but the downstream of the first communicating portion 31, and the fresh toner is supplied thereto.

Between the recycled toner supply portion 29 and the toner delivery opining 116*b*, a recycled toner supply path (used developer supply path) 28 is provided to supply the recycled toner supplied from the photosensitive drum cleaner 116 to the recycle toner supply portion 29 located on the downstream side of the first chamber 24.

The recycle toner supply path 28 is provided with a recycled toner supply mechanism (used developer supply mechanism or used developer supply means) 28*a* that supplies the recycled toner delivered from the toner delivery opening 116*b* of the photosensitive drum cleaner 116 actively to the recycled toner supply portion 29. Further, between the recycled toner supply portion 29 and the upstream side of the third chamber 26, a conveying blade 25*b* is arranged on the front end side of the second mixer 25*a*. The recycled toner supply mechanism 28*a* and the conveying blade 25*b* serve to loosen the recycled toner delivered from the photosensitive drum cleaner 116 to a certain degree, and then supply it to the recycled toner supply portion 29 or the third chamber 26. With this structure, it is possible to increase the stirring properties for the recycled toner in the third chamber 26 in the later stage.

It should be noted here that the recycled toner conveying speed of the recycled toner supply mechanism 28*a* and the conveying blade 25*b* should preferably be set faster than the second speed, which is the developer conveying speed of the third mixer 26*a*. With this structure, the stirring properties for the recycled toner in the third chamber 26 in the later stage can be further improved.

In this embodiment, the first mixer 24*a* and the second mixer 25*a* that serve to convey the toner at the first speed, each have a forward conveying blade that conveys the developer in a forward direction as each one of the mixers is rotated in a predetermined direction, whereas the third mixer 26*a* that serves to convey the toner at the second speed, has a forward conveying blade that conveys the developer in a forward direction and a backward conveying blade that conveys the blade in an opposite direction to the forward direction. With this structure, the second speed of the third mixer 26*a* is rendered slower than the first speed, thereby allowing a time to fully charge the recycled toner conveyed in the third chamber 26 by friction (triboelectrification). Consequently, the stirring amount of the recycled toner conveyed in the third chamber 26 can be rendered larger than the stirring amount of the fresh toner, thereby making it minimize the difference in the charge level between the fresh toner and the recycled toner. It should be noted that the first mixer 24*a*, the second mixer 25*a* and the third mixer 26*a* are each designed to be able to convey the developer at an arbitrary speed in accordance with the ratio in total area between the forward conveying blade and the backward conveying blade.

Further, although it is not illustrated in the figures, it is alternatively possible to have such a structure that the first mixer 24*a*, the second mixer 25*a*, the third mixer 26*a*, the photosensitive drum 103, the collected toner conveying roller 116*a*, the recycled toner supply mechanism 28*a* and the like are coupled with a main motor 55 (see FIG. 5), and they can be rotated by means of the rotational force of the main motor 55.

Further, below the second chamber 25, the magnetic sensor 21 is provided on the downstream side of the fresh toner supply portion 30 in the moving direction of the developer.

Figure 5:
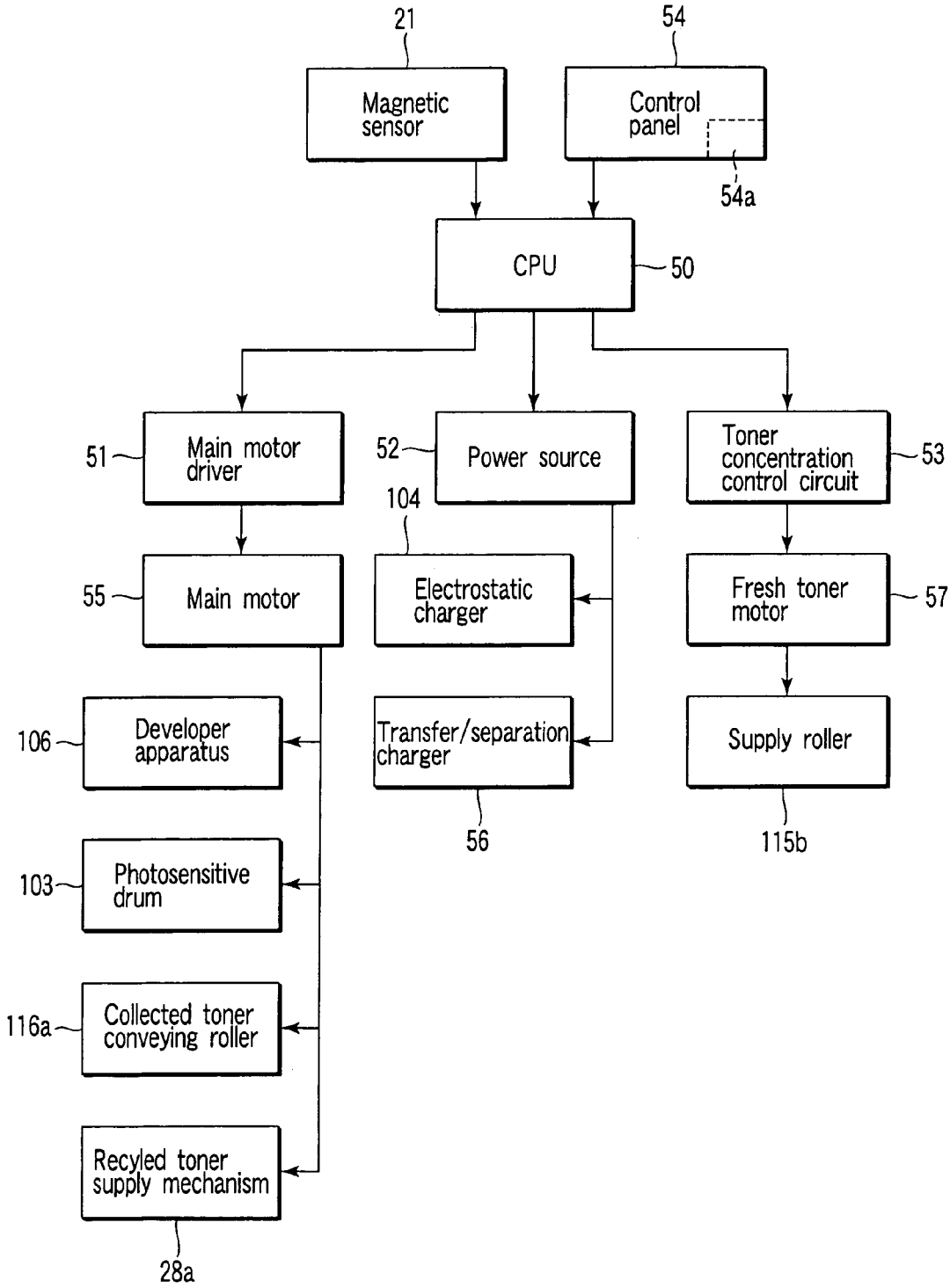
FIG. 5 is a block diagram illustrating the control system for the image forming unit shown in FIG. 1.

FIG. 5 is a block diagram illustrating a control system for the image forming unit 102 shown in FIG. 1.

As shown in FIG. 5, a main motor driver 51, a power supply unit 52, a toner concentration control circuit 53, a control panel 54 and the magnetic sensor 21 are connected to a CPU 50.

The control panel 54 includes a display portion 54*a*, with which predetermined operations, for example, an instruction of scanning an image with the scanner 101, an instruction of forming an image with the image forming unit 102 or both instructions of scanning an image and forming an image, are input.

The magnetic sensor 21 detects the ratio between the carrier (for example, iron or ferrite) contained in the developer container 20 of the developer unit 106 and the toner (for example, resin) as the toner concentration, and outputs the detected value to the CPU 50. The CPU 50 compares the detected value of the toner concentration input from the magnetic sensor 21 with a predetermined reference value. When the detected value is lower than the reference value, a toner supply signal is output to the toner concentration control circuit 53. In more detail, the CPU 50 outputs the toner supply signal, which instruct to supply of toner, to the toner concentration control circuit 53 for a predetermined period of time in accordance with the level of the output voltage input from the magnetic sensor 21 to indicate the toner concentration.

The main motor driver 51 is connected to the main motor 55, and it outputs a drive signal when an instruction of forming an image is made via the control panel 54.

The main motor 55 is coupled with the first to third mixers 24*a* to 26*a* of the developing unit 106, the developer roller 27, the photosensitive drum 103, the collected toner conveying roller 116*a* and the recycle toner supply mechanism 28*a*. When a drive signal is input from the main motor driver 51, the motor applies a predetermined driving force to these members.

The power supply unit 52 is connected to the electrostatic charging unit 104 and the transfer separation charger 56. When an instruction of scanning an image is made via the control panel 54, the power supply unit 52 outputs a predetermined voltage after a lapse of a certain period of time or immediately.

The electrostatic charging unit 104, when a predetermined voltage is applied from the power supply unit 52, discharges and thus applies a predetermined charge on the surface of the photosensitive drum 103.

The toner concentration control circuit 53 is connected to the fresh toner motor 57. When a toner supply signal is input from the CPU 50, the fresh toner motor 57 operates for a predetermined time period.

The fresh toner motor 57 adds a predetermined amount of fresh toner to the fresh toner supply portion 30 via the supply roller 115*b* operated by the toner concentration control circuit 53.

In other words, the amount of supply of fresh toner can be determined in accordance with the level of the toner concentration in the developer container 20. For example, when the toner concentration is very much decreased, the time for supplying the fresh toner becomes longer.

Next, the method of operating the image forming apparatus 100 will now be described. It should be noted first that the following embodiment will be described in connection with the case of an image formation carried out by the reversal development.

For example, when instructions of both of image scanning and image formation are made from the control panel 54, the scanner 101 starts scanning of the image and the image forming portion 102 makes the electrostatic charging unit 104 to discharge by the predetermined voltage output from the power supply unit 52. Further, at the same time, the image formation is instructed, and therefore the main motor driver 51 outputs a drive signal to the main motor 55.

The scanner 101 includes, for example, a light source, a lens and a charge coupling device (CCD). The scanner 101 forms an image of reflection light from an object to be copied, on the light receiving surface of the CCD by means of the lens, and obtains the image signal from the reflection light that is optoelectronically converted by the CCD. Thus obtained image signal is output to the exposure unit 105, where it is converted into a laser beam LB having a predetermined light intensity.

The laser beam LB is irradiated onto the surface of the photosensitive drum 103 that is uniformly charged at a negative charge by the electrostatic charging unit 104, and thus the potential at the portion irradiated with the laser beam LB becomes closer to zero. In other words, a latent image is formed on the surface of the photosensitive drum 103.

To the latent image section on the surface of the photosensitive drum 103, on which the laser beam LB has been irradiated to make it have a predetermined potential level, toner negatively charged by the developer unit 106 is attracted, and thus a toner image is formed.

The toner image is conveyed to the transfer position by the aligning roller 110, and then transferred onto a sheet Q that is charged at a positive charge by the transfer unit 111.

The toner image transferred onto the sheet Q is fused and fixed thereon by the fuser 112, and thus an image is formed on the sheet Q.

The sheet Q on which the image has been formed by the fuser 112 is fed out to the output tray 114 by the feed-out roller 113.

On the other hand, the portion of the toner that has not been transferred onto the sheet Q from the surface of the photosensitive drum 103, but has reached the photosensitive drum cleaner 116, is collected by the photosensitive drum cleaner 116.

The collected recycle toner is gathered by the collected toner conveying roller 116*a* to the front side, and then delivered from the toner delivery opening 116*b*. The recycle toner delivered from the toner delivery opening 116*b* is supplied to the recycle toner supply portion 29 via the recycle toner supply mechanism 28*a*, to be re-used as the recycle toner. On the other hand, a decrease in the toner concentration within the developer container 20 is detected by the magnetic sensor 21, the toner concentration control circuit 53 drives the fresh toner motor 57 for a predetermined time period (a predetermined number of times of rotation) to supply the fresh toner to the fresh toner supply portion 30.

Further, in the case where the toner concentration detected by the magnetic sensor 21 is not increased even if the toner concentration control circuit 53 outputs a drive signal for a predetermined time period or more to operate the supply roller 115*b*, the display portion 54*a* displays that the fresh toner in the fresh toner cartridge 115*a* has been used up to report the running out of toner to the user.

Next, the operation of the developer unit 106 will now be described with reference to FIG. 4.

When the instruction of the image formation (or image formation that includes an image scan) is input from the control panel 54, for example, the main motor driver 51 of the image forming portion 102 outputs a drive signal to the main motor 55.

When the drive signal is input from the main motor 55, the first mixer 24*a*, the second mixer 25*a* and the third mixer 26*a* and the developer roller 27 of the developer unit 106 are rotated in the predetermined directions at the predetermined speeds, respectively.

As the first mixer 24*a* is rotated, the developer in the first chamber 24 is moved in the first direction A1, and the developer thus conveyed to the downstream side goes through the first communicating portion 31 to reach the upstream of the second chamber 25. The developer that has reached the second chamber 25 is mixed with the fresh toner supplied from the fresh toner supply portion 30, and the mixture is moved in the second direction A2 to reach the upstream side of the first chamber 24 in the downstream side of the second chamber 25. As described, the developer containing at least the refresh toner is conveyed in the first conveying path made of the first chamber 24 and the second chamber 25, while the developer is being stirred.

The developer thus conveyed to the downstream side by the first mixer 24*a*, which includes the recycled toner supplied from the recycled toner supply portion 29, moves to reach the upstream of the third chamber 26. The developer that has reached the third chamber 26 is then moved in the second direction, and conveyed to the upstream side of the first chamber 24 on the downstream side. With this structure, the developer that contains at least recycled toner is conveyed through the second conveying path made of the first chamber 24 and the third chamber 26, where the developer is being stirred. It should be noted that the second conveying path includes the first chamber 24, which is also a part of the first conveying path. Further, as described above, the fresh toner supply portion 30 is located on a rear side to the recycled toner supply portion 29. That is, in the front side, the second conveying path is a path that runs on an outer side than the route of the first conveying path. Naturally, the second conveying path is longer than the first conveying path.

In this manner, the developer conveyed to the upstream side of the first chamber 24 is stirred while it is conveyed in the first direction A1, and at the same time, it is guided onto the surface of the photosensitive drum 103 by the developer roller 27.

As described above, the developer unit 106 of this embodiment has such a structure that the second conveying path, which is the conveying path for the recycled toner, can be made longer by providing the recycled toner supply portion 29 on the downstream side of the first chamber 24. With this structure, the stirring amount of the recycled toner can be increased.

Further, as mentioned above, with the recycle toner supply path 28 provided with a recycled toner supply mechanism 28*a*, it is possible to supply the recycled toner delivered from the photosensitive drum cleaner 116 to the recycled toner supply portion 29 after loosening the toner to a certain degree. Further, with the conveying blade 25*b* provided between the recycled toner supply portion 29 and the third chamber 26, the recycled toner delivered from the recycled toner supply portion 29 to the third chamber 26 can be loosened to a certain degree. With this structure, it is possible to increase the stirring properties for the recycled toner in the third chamber 26 in the later stage.

Moreover, the second partition 23, which is formed to have an L-letter shape, functions as a shut-off plate that inhibits the developer containing the fresh toner in the second chamber 25 from entering thereinto, thereby making it possible to prevent the fresh toner from flowing into the third chamber 26. With this structure, the recycled toner supplied from the recycled toner supply portion 29 can be stirred and mixed fully in the third chamber 26 and then supplied to the photosensitive drum 103, thereby making it possible realize a high-quality image formation. It should be pointed out here that if the recycled toner is supplied to the photosensitive drum 103 without being fully stirred in the third chamber 26, such uncharged toner, due to lack of charge amount, may attach to other parts of the photosensitive drum than the latent image formed thereon, or it may scatter off on the photosensitive drum or paper sheet. With the advantage of this embodiment, such drawbacks can be solved.

In the above-described embodiment, it is preferable that the two-component developer in the developer container 20 should have a ratio of about 95% (by mass) of carrier and 5% (by mass) of toner. The ratio between the carrier and toner is detected by the magnetic sensor 21, and toner is supplied from the fresh toner supply unit 115 in accordance with the results of the detection.

The present invention is not limited directly to the above-described embodiment, but the structural elements of the invention, when actually practicing it, can be remodeled as long as the essence of the invention remains. Further, various modifications can be made by appropriately combining some of the structural elements disclosed in the above-described embodiment. For example, some of the structural elements may be deleted from all the elements used in the embodiment. Furthermore, structural elements of different versions of the embodiment may be combined in an appropriate manner.

For example, in the above-described embodiment, the recycled toner supply path 28 is provided with the recycled toner supply mechanism 28*a*; however the present invention is not limited to this structure described here, but the recycled toner supply mechanism 28*a* may not necessarily be provided. In this case, the structure should be changed to such that the toner delivery opening 116*b* of the photosensitive drum cleaner 116 is located above the recycled toner supply portion 29 of the developer unit 106, and thus recycled toner is supplied to the recycled toner supply portion 29 by free fall of the toner. In this version, the recycled toner can be supplied to the recycled toner supply portion 29 by free fall, and therefore such a complicated conveying means is not longer necessary.

Further, the recycled toner supply mechanism 28*a* should only be of such a type that actively conveys the recycled toner to the third chamber 26 while loosening it, and therefore it may be of, for example, an auger type that has a helical blade along its shaft, or a type that has a wide and flat blade formed on its shaft, such as a paddle or propeller.

Furthermore, the recycled toner supply path 28 may be simply a passing region for the recycled toner when the recycled toner delivered from the toner delivery opening 116*a* is supplied to the recycled toner supply portion 29, or it may be a guide portion that actively guides the recycled toner delivered from the toner delivery opening 116*a* to the recycled toner supply portion 29.

Still furthermore, when the photosensitive drum cleaner 116 is arranged on an opposite side to the developer unit 106 via the photosensitive drum 13, and the recycled toner supply portion 29 is placed in the first chamber provided close to the developer roller 27, the conveying path from the photosensitive drum cleaner 116 to the developer unit 106, that is, the recycled toner supply portion 29 can be shortened.

What is claimed is:

1. A developer apparatus comprising:

a first chamber including a first mixer that conveys a developer in a first direction while stirring the developer;

a second chamber including a second mixer that conveys the developer supplied from the first chamber in a second direction different from the first direction while stirring the developer;

a third chamber including a third mixer that conveys the developer supplied from the first chamber in the second direction while stirring the developer;

a fresh developer supply portion located on an upstream side of the second chamber, that receives fresh developer; and a recycled developer supply portion located on an downstream side of the first chamber, that receives recycled developer.

2. The developer apparatus according to claim 1, further comprising:

a conveying blade provided near the recycled developer supply portion, that conveys the supplied recycled developer to an upstream side of the third chamber.

3. The developer apparatus according to claim 1, further comprising:

a first conveying path including the first chamber and the second chamber, in which the second mixer conveying the fresh developer at the first speed is provided; and a second conveying path including the first chamber and the third chamber, in which the third mixer conveying the recycled developer at the second speed which is slower than the first speed is provided.

4. The developer apparatus according to claim 3, wherein the second conveying path is longer than the first conveying path in length.

5. The developer apparatus according to claim 1, further comprising:

a developer carrier member that carries developer thereon to supply the developer to an image carrier, which is formed as one unit with a main body of an image forming apparatus but being detachable therefrom.

6. The developer apparatus according to claim 5, wherein the apparatus includes the image carrier being integrated therewith as a processing unit.

7. An image forming apparatus comprising:

an imager carrier that carries an developer image made of a developer by means of electrostatic; and a developer apparatus including: a first chamber including a first mixer that conveys a developer in a first direction while stirring the developer to supply the toner to the image carrier; a second chamber including a second mixer that conveys the developer supplied from the first chamber in a second direction different from the first direction while stirring the developer; a third chamber including a third mixer that conveys the developer supplied from the first chamber in the second direction while stirring the developer; a fresh developer supply portion located on an upstream side of the second chamber, that receives fresh developer; and a recycled developer supply portion located on an downstream side of the first chamber, that receives recycled developer.

8. The image forming apparatus according to claim 7, further comprising:

an electrostatic charger that chargers a surface of the image carrier to have a predetermined potential;

a collecting mechanism including a delivery opening located above the recycled developer supply portion, that delivers the recycled developer collected from the image carrier to the recycled developer supply portion via the delivery opening; and a process unit including the image carrier, the developer apparatus, the electrostatic charger and the collecting mechanism, that is detachable from the main body of the image forming apparatus.

9. The image forming apparatus according to claim 8, further comprising:

a recycled developer supply mechanism that supplies the recycled developer delivered via the delivery opening to the recycled developer supply portion.

10. The image forming apparatus according to claim 8, wherein the recycled developer is supplied to the recycled developer supply portion via the delivery opening by a free-fall manner.

11. The image forming apparatus according to claim 8, further comprising:

a recycled developer supply path that guides the recycled developer delivered via the delivery opening to the recycled developer supply portion.

12. The image forming apparatus according to claim 7, further comprising:

a first conveying path including the first chamber and the second chamber, in which the second mixer conveying the fresh developer at the first speed is provided; and a second conveying path including the first chamber and the third chamber, in which the third mixer conveying the recycled developer at the second speed which is slower than the first speed is provided.

13. The image forming apparatus according to claim 12, wherein the second conveying path is longer than the first conveying path in length.

14. An image forming apparatus comprising:

an imager carrying means for carrying an developer image made of a developer by means of electrostatic; and a developing means including: a first developer containing means including a first stirring means, for conveying a developer in a first direction while stirring the developer to supply the developer to the image carrying means; a second developer containing means including a second stirring means, for conveying the developer supplied from the first developer containing means in a second direction different from the first direction while stirring the developer; a third developer containing means including a third stirring means for conveying the developer supplied from the first developer containing means in the second direction while stirring the developer; a fresh developer supply portion located on an upstream side of the second developer containing means, that receives fresh developer; and a recycled developer supply portion located on an downstream side of the first developer containing means, that receives recycled developer.

15. The image forming apparatus according to claim 14, further comprising:

an electrostatic charging means for charging a surface of the image carrying means to have a predetermined potential;

a collecting means including a delivering means located above the recycled developer supply portion, for delivering the recycled developer collected from the image carrying means to the recycled developer supply portion via the delivering means; and a process unit including the image carrying means, the developing means, the electrostatic charging means and the collecting means, that is detachable from the main body of the image forming apparatus.

16. The image forming apparatus according to claim 15, further comprising:

a recycled developer supplying means for supplying the recycled developer delivered via the delivering means to the recycled developer supply portion.

17. The image forming apparatus according to claim 15, wherein the recycled developer is supplied to the recycled developer supply portion via the delivering means by a free-fall manner.

18. The image forming apparatus according to claim 15, further comprising:

a recycled developer supply path that guides the recycled developer delivered via the delivering means to the recycled developer supply portion.

19. The image forming apparatus according to claim 14, further comprising:

a first conveying path including the first developer containing means and the second developer containing means, in which the second stirring means for conveying the fresh developer at the first speed is provided; and a second conveying path including the first developer containing means and the third developer containing means, in which the third stirring means for conveying toner that contains the recycled developer at the second speed which is slower than the first speed is provided.

20. The image forming apparatus according to claim 19, wherein the second conveying path is longer than the first conveying path in length.

21. A developer supplying method comprising: collecting a recycled developer from a surface of an image carrier;

delivering the recycled developer from a delivery opening of a cleaner to a recycled toner supply portion located on a downstream side of a first chamber;

supplying fresh toner to a fresh toner supply portion located on an upstream side of a second chamber at a predetermined timing;

conveying the developer supplied from the first chamber while stirring the developer by using a second mixer provided in the second chamber to supply the developer to the upstream side of the first chamber;

conveying the developer supplied from the first chamber while stirring the developer by using a third mixer provided in the third chamber to supply the developer to the upstream side of the first chamber; and conveying the developer supplied from the second chamber and third chamber while stirring the developer by using a first mixer provided in the first chamber to supply the developer to the surface of the image carrier.

22. The developer supplying method according to claim 21, wherein the recycled developer is delivered to the recycled developer supply portion via the delivery opening after loosening the developer by a recycled developer supply mechanism.

23. The developer supplying method according to claim 21, wherein the recycled developer is supplied to the recycled developer supply portion via the delivering means by a free-fall manner.

24. The developer supplying method according to claim 21, wherein the recycled developer is delivered to the recycled developer supply portion from the delivery opening via a recycled developer supply path provided between the recycled developer supply portion.

* * * * *